US007571713B2

(12) United States Patent
De Luca et al.

(10) Patent No.: US 7,571,713 B2
(45) Date of Patent: Aug. 11, 2009

(54) HIGH-PRESSURE PUMP FOR A FUEL INJECTION SYSTEM OF AN INTERNAL COMBUSTION ENGINE

(75) Inventors: Alessandro De Luca, Bari-Palese (IT); Vittorio Caroli, Bari (IT); Angela Cavallo, Grottaglie (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/660,454

(22) PCT Filed: Jul. 5, 2005

(86) PCT No.: PCT/EP2005/053183

§ 371 (c)(1),
(2), (4) Date: Feb. 16, 2007

(87) PCT Pub. No.: WO2006/024569

PCT Pub. Date: Mar. 9, 2006

(65) Prior Publication Data

US 2007/0251499 A1 Nov. 1, 2007

(30) Foreign Application Priority Data

Aug. 28, 2004 (DE) ..... 10 2004 041 764

(51) Int. Cl.
*F02M 57/02* (2006.01)

(52) U.S. Cl. ..... 123/446; 251/206

(58) Field of Classification Search ..... 251/61.2, 251/63.5, 63.6, 206, 343; 137/511; 123/446
See application file for complete search history.

(56) References Cited

U.S. PATENT DOCUMENTS

| | | | | |
|---|---|---|---|---|
| 3,338,257 | A * | 8/1967 | Ferguson | 137/112 |
| 4,569,273 | A * | 2/1986 | Anderson et al. | 91/447 |
| 5,676,169 | A * | 10/1997 | Landrum | 137/106 |
| 5,738,142 | A * | 4/1998 | Eike et al. | 137/596.17 |
| 6,332,761 | B1 | 12/2001 | Guenter et al. | |
| 6,450,788 | B1 | 9/2002 | Grabert | |

FOREIGN PATENT DOCUMENTS

| | | |
|---|---|---|
| DE | 679 246 | 8/1939 |
| DE | 197 44 577 A1 | 4/1999 |

* cited by examiner

*Primary Examiner*—Stephen K Cronin
*Assistant Examiner*—J. Page Hufty
(74) *Attorney, Agent, or Firm*—Ronald E. Greigg

(57) ABSTRACT

The high-pressure pump has at least one pump element with a pump piston driven in a reciprocating motion and guided displaceably in a cylinder bore of a pump housing part which piston defines a pump work chamber that can be filled with fuel from a fuel inlet via a suction valve in the intake stroke. The suction valve has a pistonlike valve member which has a cylindrical shaft and a head of larger cross section at least the shaft is guided displaceably in a guide bore of a valve housing. The head of the valve member is also guided displaceably in a bore of the valve housing, via guide portions embodied on the valve member and spaced apart from one another in the circumferential direction; between the guide portions, flowthrough portions of reduced cross section compared to the guide portions provide for fuel flow out of the fuel inlet into the pump work chamber.

20 Claims, 4 Drawing Sheets

HIGH-PRESSURE PUMP FOR A FUEL INJECTION SYSTEM OF AN INTERNAL COMBUSTION ENGINE

CROSS-REFERENCE TO RELATED APPLICATION

This application is a 35 USC 371 application of PCT/EP 2005/053183 filed on Jul. 5, 2005.

BACKGROUND OF THE INVENTION

1. Field of the Invention

The invention is directed to an improved high-pressure pump for a fuel injection system of an internal combustion engine as generically defined by the preamble to claim 1.

2. Description of the Prior Art

One high-pressure pump, known from German Patent Disclosure DE 197 44 577 A1, has at least one pump element, with a pump piston that is driven in a reciprocating motion and guided displaceably in a cylinder bore of a pump housing part and in the cylinder bore defines a pump work chamber. In the intake stroke of the pump piston, the pump work chamber is filled with fuel from a fuel inlet via a suction valve, and in the pumping stroke of the pump piston, fuel is positively displaced out of the pump work chamber via an outlet valve. The suction valve has a pistonlike valve member, which for controlling the communication of the pump work chamber with the fuel inlet cooperates with a sealing face, embodied on the fuel inlet, with a valve seat embodied in a valve housing. The valve member is engaged by a closing spring that acts on it in the closing direction. The valve member has a shaft and a head of enlarged diameter compared to the shaft, and the shaft is guided displaceably in a bore in the valve housing. It has been found that the valve member upon its closing motion can tilt with its longitudinal axis, resulting in an initially one-sided contact of the sealing face with the valve seat. This tilting is caused by the inadequate guidance of the valve member with its shaft in the bore of the valve housing. Particularly in the case of fuels with poor lubricating properties, this tilting of the valve member and the resultant one-sided contact of the sealing face of the valve member with the valve seat lead to major wear of the valve member and/or the valve seat and hence to an impairment of function, and in some circumstances even the failure of the suction valve and hence of the high-pressure pump.

SUMMARY AND ADVANTAGES OF THE INVENTION

The high-pressure pump of the invention has the advantage over the prior art that the guidance of the valve member of the suction valve is improved, thus reducing wear and improving the durability of the suction valve and hence of the high-pressure pump.

Advantageous features and refinements of the high-pressure pump of the invention are disclosed. One embodiment makes fast closure of the suction valve possible, since an elevated pressure cannot build up in the chamber. Another embodiment in a simple way enables the delivery of fuel into the suction valve and the communication of the chamber defined by the valve member with the fuel inlet.

BRIEF DESCRIPTION OF THE DRAWINGS

Two exemplary embodiments of the invention are described herein below, with reference to the drawings, in which.

DESCRIPTION OF THE PREFERRED EMBODIMENTS

Figure 1:
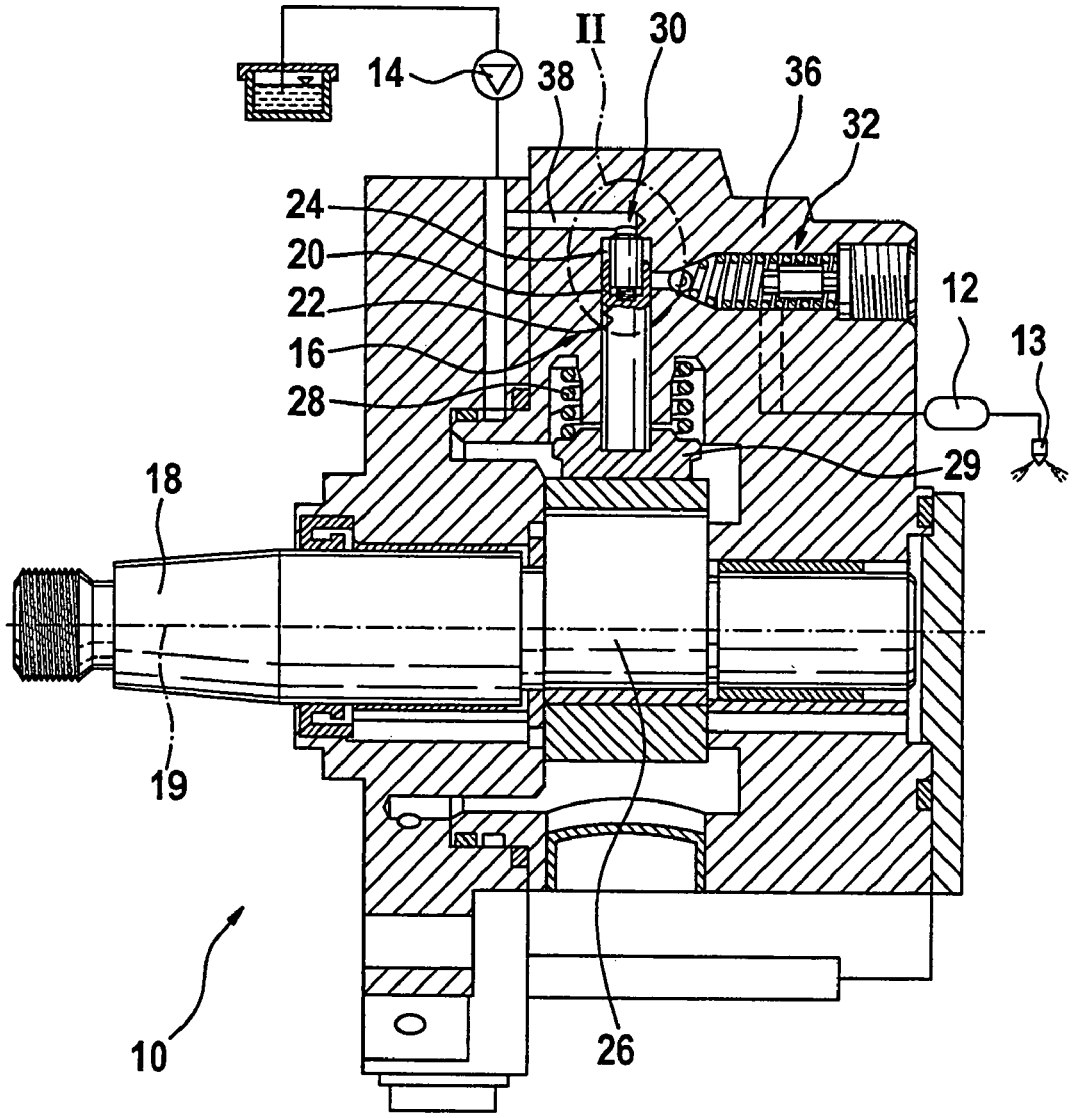
FIG. 1 is a longitudinal sectional view of a high-pressure pump for a fuel injection system of an internal combustion engine.

In FIG. 1, a high-pressure pump 10 is shown for a fuel injection system of an internal combustion engine, which is preferably a self-igniting engine. By means of the high-pressure pump 10, fuel is pumped at high pressure into a reservoir 12, from which fuel is withdrawn for injection to the engine by injectors 13. The high-pressure pump 10 is supplied with fuel by a feed pump 14. The high-pressure pump 10 has at least one pump element 16, which has a pump piston 20 driven in a reciprocating motion at least indirectly by a drive shaft 18 of the high-pressure pump 10. The pump piston 20 is guided tightly in a cylinder bore 22 that extends at least approximately radially to the drive shaft 18, and the pump piston defines a pump work chamber 24 in the outer end region of the cylinder bore 22, facing away from the drive shaft 18. The drive shaft 18 has a cam or a shaft portion 26 that is eccentric to its axis 19 of rotation, by way of which cam or portion the reciprocating motion of the pump piston 20 is brought about upon the rotary motion of the drive shaft 18. The pump piston 20 is kept in contact with the shaft portion 26 by a restoring spring 28 either directly or via a support element 29.

The pump work chamber 24 can be made to communicate with a fuel inlet from the feed pump 14 via a suction valve 30, embodied as a check valve, that opens into the pump work chamber 24. The pump work chamber 24 can furthermore be made to communicate with a fuel outlet to the reservoir 12 via an outlet valve 32, embodied as a check valve, that opens out of the pump work chamber 24. In the intake stroke, the pump piston 20 moves radially inward in the cylinder bore 22, so that the volume of the pump work chamber 24 increases. In the intake stroke of the pump piston 20, because of the pressure difference that then exists, the suction valve 30 is opened, since a higher pressure than the pressure prevailing in the pump work chamber 24 is generated by the feed pump 14, and thus the fuel pumped by the feed pump 14 is aspirated into the pump work chamber 24. The outlet valve 32 is closed in the intake stroke of the pump piston 20, since a higher pressure prevails in the reservoir 12 than in the pump work chamber 24.

Figure 2:
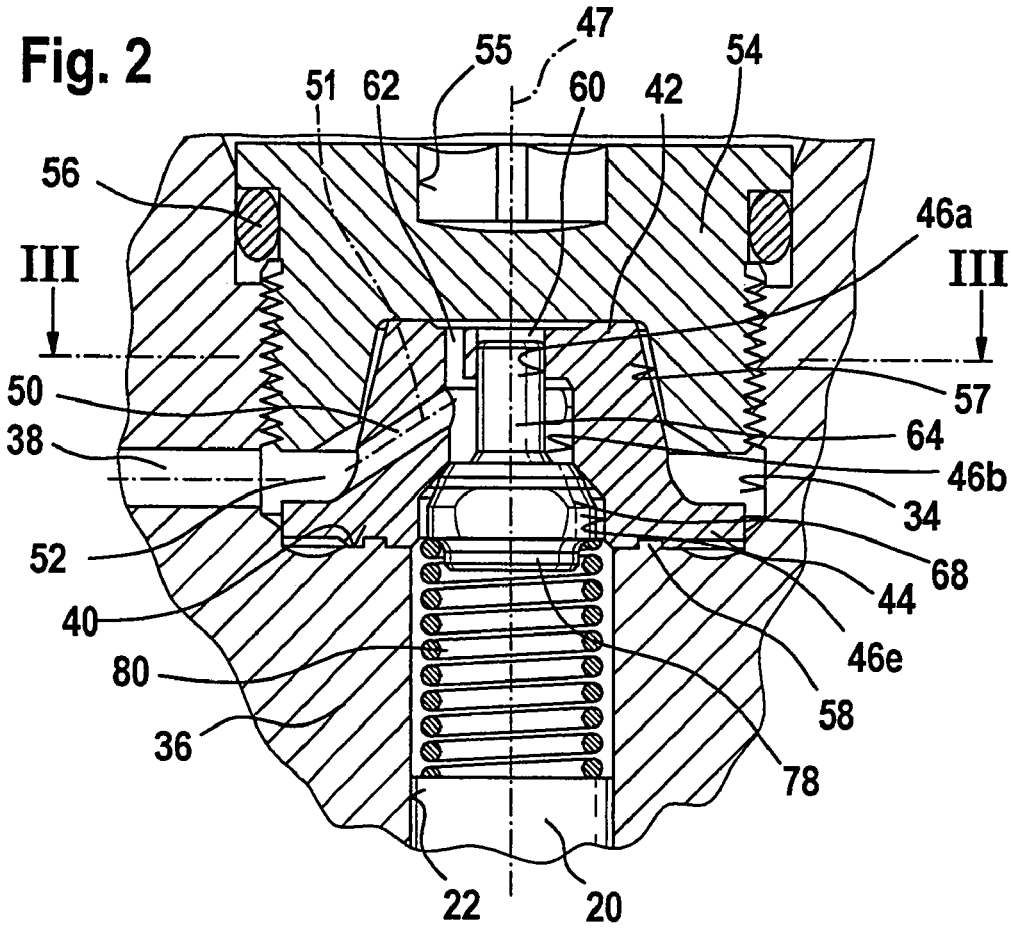
FIG. 2 shows a suction valve of the high-pressure pump in a first exemplary embodiment of the invention, shown in an enlarged longitudinal section.

The suction valve 30 will now be described in further detail in terms of FIGS. 2 through 6, in which the suction valve 30 is shown in a first exemplary embodiment. As shown in FIG. 2, the suction valve 30 is inserted into a bore 34, which radially outward adjoins the cylinder bore 22, of a housing part 36 of the high-pressure pump 10. The bore 34 is embodied as larger in diameter than the cylinder bore 22. The housing part 36 may for instance be a cylinder head, which is connected to some other housing part in which the drive shaft 18 is supported, or it may be a housing part in which the drive shaft 18 is supported. A fuel inlet conduit 38, which communicates with the feed pump 14, discharges into the bore 34, near its end region toward the cylinder bore 22, for instance approximately radially to the axis of the bore 34. At the transition between the bore 34 and the cylinder bore 22, an annular shoulder 40 on the housing part 36 is formed that points toward the outside of the housing part 36.

Figure 4:
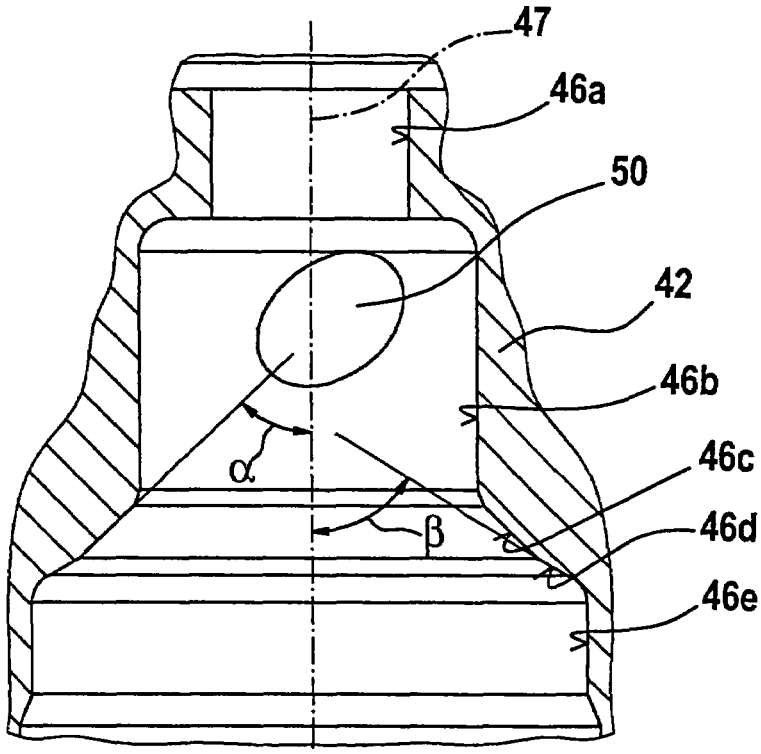
FIG. 4 shows a valve housing of the suction valve in an enlarged longitudinal section.

As shown in FIGS. 2 and 4, the suction valve 30 has a valve housing 42, which is embodied as approximately cup-shaped. The valve housing 42, on its inner end toward the annular shoulder 40, has a flange 44 of increased outer diameter. Adjoining the flange 44, the outer diameter of the valve housing is less, and it can decrease, for instance approximately frustoconically, toward the outer end of the valve housing 42, facing away from the annular shoulder 40. The valve housing 42 has a through bore 46, which is embodied as multiply stepped in diameter. In the outer end region of the valve housing 42, the bore 46 has a first portion 46*a* of small diameter, which is adjoined toward the inner end of the valve housing 42 by a second bore portion 46*b* of larger diameter. The second bore portion 46*b* is adjoined by a third bore portion 46*c*, whose diameter increases at least approximately frustoconically toward the inner end of the valve housing 42, and whose jacket face is inclined by an angle $\alpha$ to the longitudinal axis 47 of the bore 46. The third bore portion 46*c* forms a valve seat. The third bore portion 46*c* is adjoined by a fourth bore portion 46*d*, whose diameter increases at least approximately frustoconically toward the inner end of the valve housing 42, and whose jacket face is inclined by an angle $\beta$ to the longitudinal axis 47 of the bore 46. The angle $\beta$ of the fourth bore portion 46*d* is greater than the angle $\alpha$ of the third bore portion 46*c*. The fourth bore portion 46*d* is finally adjoined, toward the inner end of the valve housing 42, by a fifth bore portion 46*e* of constant diameter. At the transition between the second bore portion 46*b* and the third bore portion 46*c*, a chamfer may be provided. The transition between the fourth bore portion 46*d* and the fifth 46*e* may be rounded.

Figure 3:
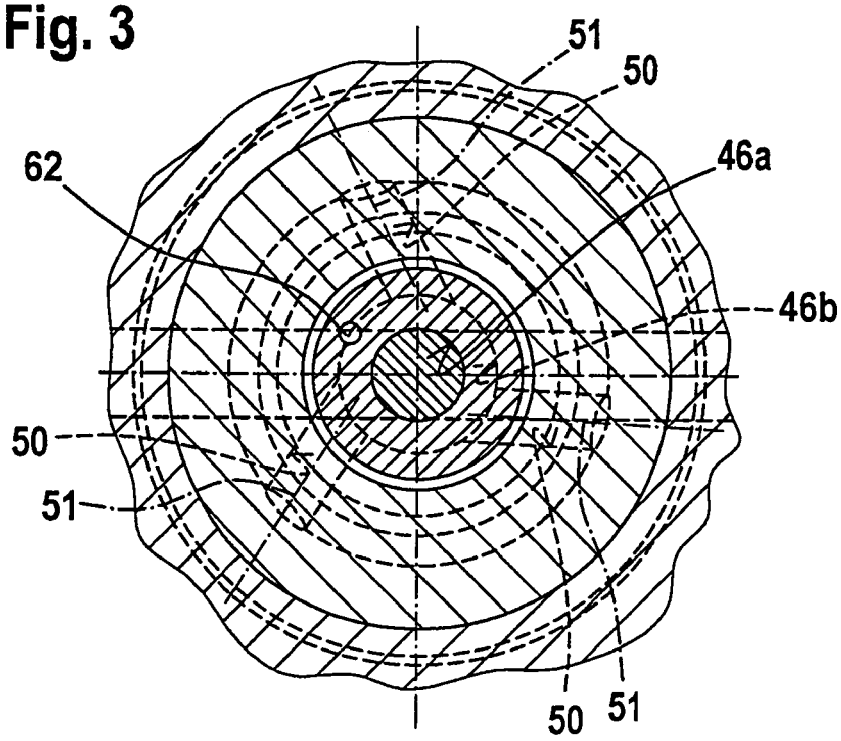
FIG. 3 shows the suction valve in a cross section taken along the line III-III of FIG. 2.

At least one inlet conduit 50 is made in the jacket of the valve housing 42; it discharges on one end at the outer jacket of the valve housing 42 and on the other in the second bore portion 46*b*. Preferably, a plurality of inlet conduits 50, for instance three of them, are provided, distributed uniformly over the circumference of the valve housing 42. The inlet conduits 50 may discharge into the bore portion 46*b* in such a way that their longitudinal axes 51 intersect the longitudinal axis 47 of the bore portion 46*b*. Alternatively, the inlet conduits 50 may also discharge into the second bore portion 46*b* in such a way that their longitudinal axes 51 do not intersect the longitudinal axis 47 of the bore 46, and the inlet conduits 50 discharge at least approximately at a tangent into the bore portion 46*b*, as is shown in FIG. 3. The inlet conduits 50 may extend with their longitudinal axes 51 at least approximately perpendicular to the longitudinal axis 47 of the bore 46, or in such a way, as shown in FIGS. 2 and 4, that the longitudinal axis 51 of the inlet conduits 50 forms an acute angle with the longitudinal axis 47 of the bore 46 toward the end of the valve housing 42 having the flange 44. Between the jacket of the valve housing 42 in the region of the orifices of the inlet conduits 50 and of the bore 34 in the housing part 36, there is an annular chamber 52, into which the fuel inlet conduit 38 discharges. The valve housing 42 is retained in the bore 34 of the housing part 36 by a retaining element 54, inserted into the bore 34, that is preferably embodied as a retaining screw that is screwed into a female thread of the bore 34. An elastic sealing ring 56, by which the bore 34 is sealed off from the outside, is fastened between the retaining screw 54 and the bore 34. By means of the retaining screw 54, the valve housing 42 is pressed with its flange 44 against the annular shoulder 40 of the housing part 36. The flange 44 and/or the annular shoulder 40 may have a raised rib 58, which as a result of the pressure of the valve member 42 against the annular shoulder 40 is deformed elastically and/or plastically and thus assures sealing off of the pump work chamber 24 from the bore 34. Alternatively, a separate sealing element may be disposed between the flange 44 and the annular shoulder 40 for sealing purposes.

On its side pointing toward the outside of the bore 34, the retaining screw 54 may have an indentation 55 of noncircular cross section, into which a suitably embodied tool can be inserted to screw the retaining screw 54 into the thread of the bore 34 or to unscrew it. On its side toward the valve housing 42, the retaining screw 54 has an indentation 57, into which the valve housing 42 plunges. The valve housing 42, in its face end toward the retaining screw 54, has a central countersinking, into which the bore 46 discharges. By means of the countersinking of the valve housing 42, a chamber 60 into which the bore 46 discharges is defined between the valve housing and the retaining screw 54. The chamber 60 communicates with the second bore portion 46*b* through at least one bore 62 in the valve housing 42, and the bore 62 extends at least approximately parallel to the first bore portion 46*a* and laterally beside it. The chamber 60 thus communicates constantly with the second bore portion 46*b* and hence with the fuel inlet conduit 38.

Figure 5:
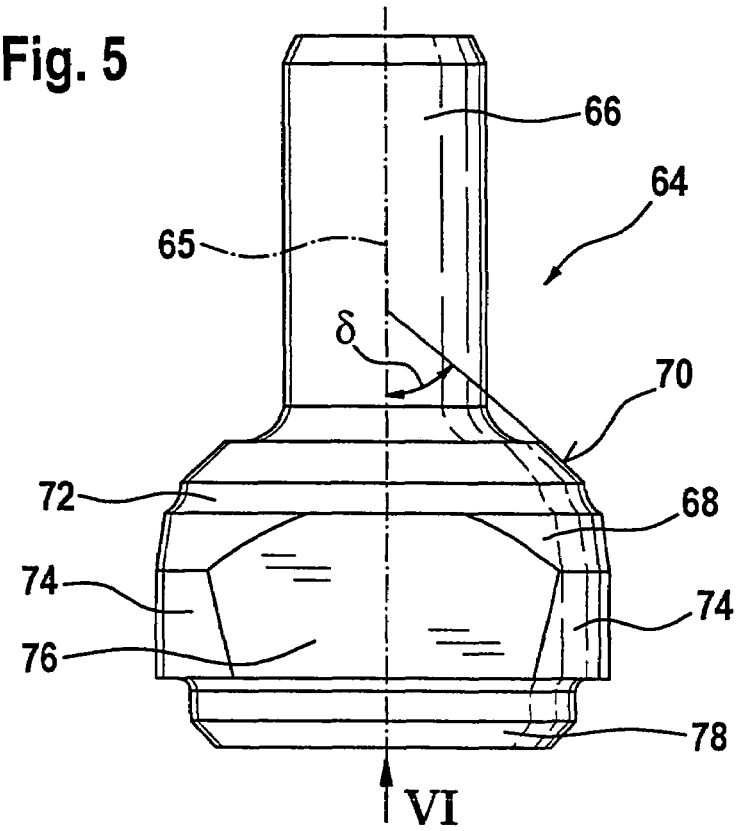
FIG. 5 shows a valve member of the suction valve.
Figure 6:
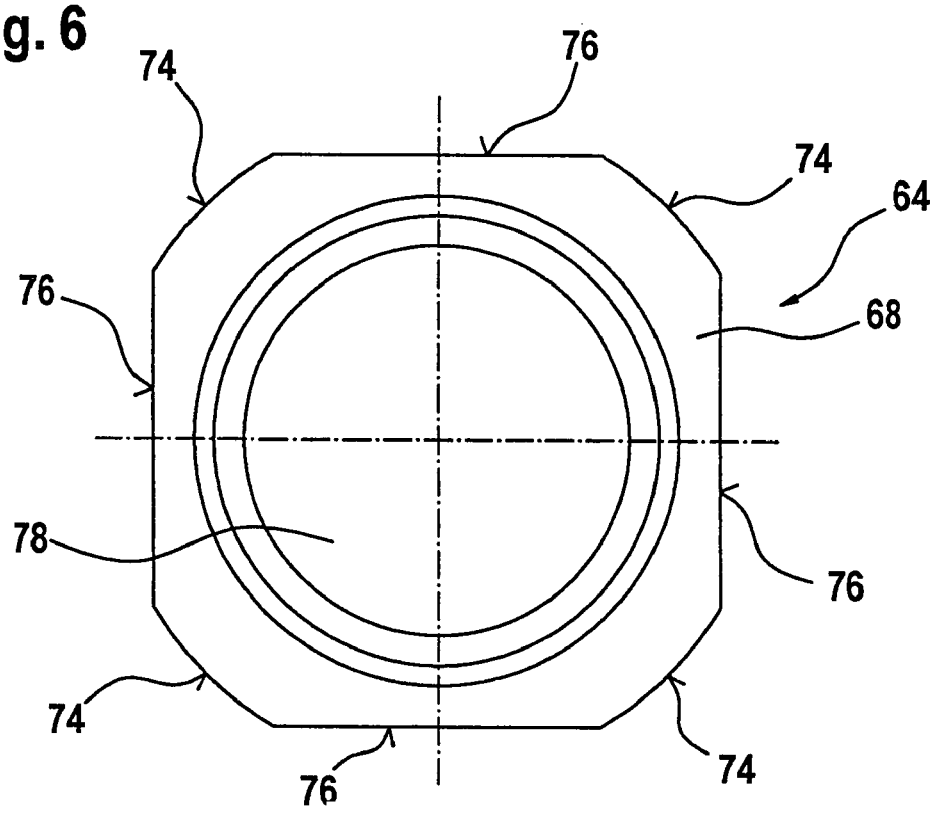
FIG. 6 shows the valve member in a view in the direction of the arrow VI in FIG. 5.

As shown in FIGS. 2, 5 and 6, the suction valve 30 furthermore has a pistonlike valve member 64, which has a cylindrical shaft 66 and a head 68 of larger cross section than the shaft 66. On the head 68, on its edge toward the shaft 66, there is a sealing face 70, which is embodied at least approximately frustoconically and whose jacket face is inclined by an angle $\delta$ to the longitudinal axis 65 of the valve member 64. The sealing face 70 is adjoined, toward the end of the head 68 facing away from the shaft 66, by a region that is cylindrical or that increases in cross section at least approximately frustoconically. In this region of the head 68, a plurality of guide portions 74 are distributed over the circumference of the head 68, spaced apart from one another, and their outer contours are located on a common diameter. The guide portions 74 may be part of the truncated cone of the region of the head 68. The guide portions 74 may, however, instead have an at least approximately cylindrical outer contour. Between the guide portions 74, there are portions 76 of reduced cross section by comparison, which are formed for instance by beveled or flattened faces on the circumference of the head 68. A short peg 78 protrudes from the face end, facing away from the shaft 66, of the head 68 of the valve member 64, at least approximately coaxially to the longitudinal axis 65 of the valve member. A relief groove may be provided both between the shaft 66 and the sealing face 70 and between the sealing face 70 and the head 68 having the guide portions 74, to make the valve member 64 simpler to manufacture. Between the sealing face 70 and the head 68 having the guide portions 74, an annular groove 72 is preferably provided. By means of the annular groove 72, the opening performance of the valve member 64 is improved, because the pressure acting in the opening direction can act on the sealing face 70, thus improving the filling of the pump work chamber 24. The wear performance of the sealing face 70 is also improved by the annular groove 72, because the wear of the sealing face 70 is stopped at the annular groove 72.

The valve member 64 is guided displaceably with little play by its shaft 66 in the first bore portion 46*a* of the valve housing 42. The first bore portion 46*a* thus forms a guide bore for the shaft 66 of the valve member 64. The valve member 64 is also guided with greater play via its guide portions 74 in the fifth bore portion 46*e* of the valve housing 42. Because of the guidance of the valve member 64 via its guide portions 74 in the fifth bore portion 46*e*, it is assured that the valve member 64 upon its motion, in particular its closing motion, can tilt only very slightly with its longitudinal axis 65 relative to the longitudinal axis 47 of the bore 46 and thus of the valve seat 46*c*, so that a uniform contact of the sealing face 70 of the valve member 64 with the valve seat 46*c* upon the closing motion is assured. The possible tilting of the longitudinal axis 65 of the valve member 64 relative to the longitudinal axis 47 of the bore 46 is limited by the guide portions 74 to a maximum of approximately 0.5°, for example, and preferably a maximum of approximately 0.25°. The angle $\alpha$ by which the jacket face of the valve seat 46*c* is inclined to the longitudinal axis 47 differs from the angle $\delta$ by which the jacket face of the sealing face 70 of the valve member 64 is inclined to the longitudinal axis 47. The angle $\alpha$ may be somewhat larger than the angle $\delta$; the difference may be relatively slight and may amount for instance to only a few degrees, or only approximately 1°.

The valve member 64 is engaged, as shown in FIG. 2, by a closing spring 80 acting on it in the closing direction, which is braced on one end on the pump piston 20 and on the other on the face end, toward the pump piston 20, of the head 68 of the valve member 64. The closing spring 80 is embodied for instance as a helical compression spring and is slipped onto the peg 78 of the valve member 64 and is centered by this peg.

The valve member 64 is urged in its opening direction by the pressure generated by the feed pump 14 and delivered to the second bore portion 46*b* via the inlet conduits 50. In the intake stroke of the pump piston 20, a higher pressure, generated by the feed pump 14, prevails in the fuel inlet than in the pump work chamber 24, so that the valve member 64 opens counter to the force of the closing spring 80 and lifts with its sealing face 70 from the valve seat 46*c* and thereby opens an annular flow cross section into the pump work chamber 24. In the region of the head 68 of the valve member 64, a sufficiently large flow cross section is opened between the portions 76 and the fifth bore portion 46*e* to enable filling of the pump work chamber 24 with fuel. The inflow of fuel from the inlet conduits 50 into the second bore portion 46*b* is effected with only slight flow losses, because of the tangential discharge of the inlet conduits 50 into the bore portion 46*b*. Because of the tangential discharge of the inflow bores 50, a spin is imparted to the inflowing fuel. The outlet of the inlet conduits 50 in the bore portion 46*b* may be rounded. Good filling of the pump work chamber 24 is thus enabled. The chamber 60 between the valve housing 42 and the retaining screw 54 communicates with the fuel inlet 38 via the bore 62, so that upon the closing motion of the valve member 64, fuel can be positively displaced from the valve member out of the chamber 60 into the fuel inlet 38, and as a result fast closing of the suction valve 30 is attained, and a pressure increase in the chamber 60 is avoided.

Upon the intake stroke of the pump piston 20, in which the piston moves inward toward the drive shaft 18, the suction valve 30 opens, since the opening force acting in the opening direction on the valve member 64 as a result of the pressure in the fuel inlet 38 is greater than the force of the closing spring 80 and the force generated in the closing direction on the valve member 64 by the low pressure prevailing in the pump work chamber 24. In the pumping stroke of the pump piston 20, in which the piston moves outward away from the drive shaft 18, the suction valve 30 closes, since the total of the force generated by the pressure prevailing in the pump work chamber 24 and the force of the closing spring 80 is greater than the opening force on the valve member 64.

Figure 7:
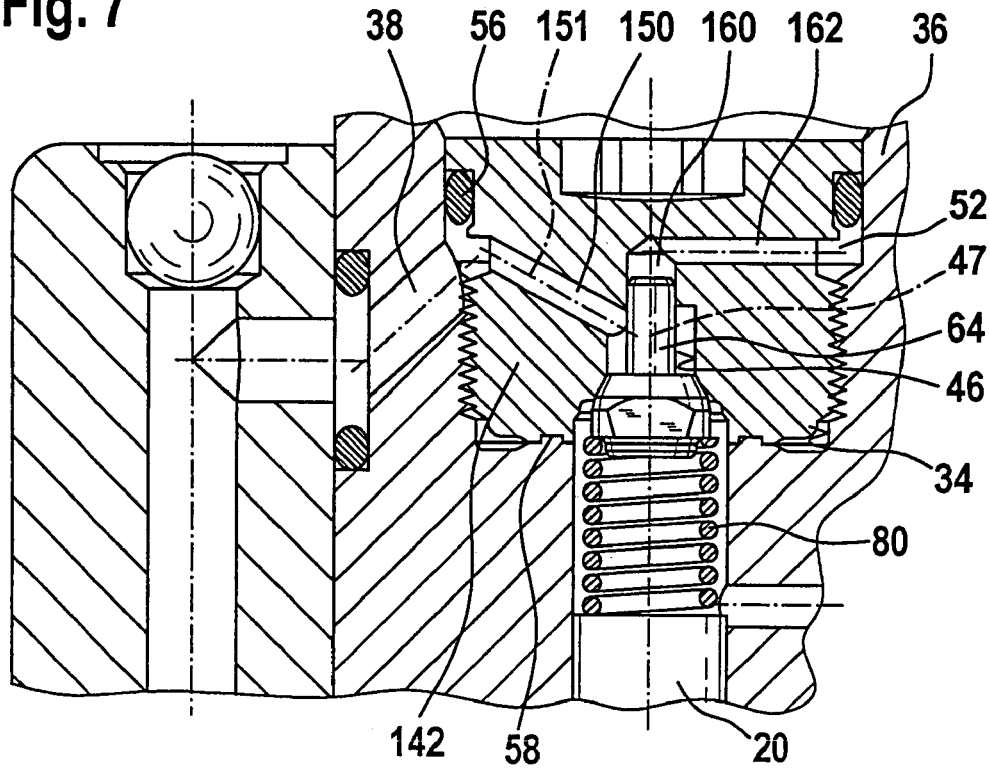
FIG. 7 shows the suction valve in a second exemplary embodiment.

In FIG. 7, the suction valve 30 is shown in a second exemplary embodiment, in which the fundamental construction is the same as in the first exemplary embodiment, but the valve housing and the retaining screw are embodied integrally as a valve housing 142. The valve member 64 of the suction valve 30 may be embodied identically to the first exemplary embodiment and will therefore not be described in detail again below. As described for the first exemplary embodiment, the bore 46 with the bore portions 46*a*, 46*b*, 46*c*, 46*d*, and 46*e* is located in the valve housing 142; the bore 46 is embodied as a blind bore. The valve member 64 is guided with its shaft 66 with little play in the guide bore 46*a* and with greater play with its head 68 via the guide portions 74 in the bore portion 46*e*. The valve housing 142 is provided with a male thread, with which it is screwed into a corresponding female thread of the bore 34 in the housing part 36 of the high-pressure pump, and the sealing off of the bore 34 from the outside is effected by means of the sealing ring 56. The sealing between the valve housing 142 and the annular shoulder 40 at the transition between the bore 34 and the cylinder bore 22 may be done identically to the first exemplary embodiment. The fuel inlet conduit 38 discharges into the annular chamber 52 surrounding the valve housing 142. A plurality of fuel inlet conduits 150 are embodied in the valve housing 142, distributed over its circumference; they discharge on one end at the outer jacket of the valve housing 142 and on the other into the second bore portion 46*b*. The course of the inlet conduits 150 is analogous to the first exemplary embodiment, and thus they preferably discharge at least approximately at a tangent into the second bore portion 46*b*. The inlet conduits 150 may extend with their longitudinal axes 151 at least approximately perpendicular to the longitudinal axis 47 of the bore 46, or as shown in FIG. 7, they may extend such that the longitudinal axis 151 of the inlet conduits 150 and the longitudinal axis 47 of the bore 46 form an acute angle toward the outer end of the valve housing 142. A bore 162 is also made in the valve housing 142; it discharges at one end at the outer jacket of the valve housing 142 into the annular chamber 52 and on the other into the first bore portion 46*a* into the chamber 160 defined by the shaft 66 of the valve member 64. Thus via the bore 162, the chamber 160 communicates constantly with the fuel inlet conduit 38. The sealing ring 56 is fastened between the valve housing 142 and the bore 34 in the housing part 36, in order to seal off the annular chamber 52, in which fuel inflow pressure generated by the feed pump 14 prevails, from the outside. The sealing off against the high pressure prevailing in the pump work chamber 24 is done as in the first exemplary embodiment between the housing part 36 and the valve housing 142 by means of a raised rib on one of these parts, or by means of a separate sealing ring.

The foregoing relates to a preferred exemplary embodiment of the invention, it being understood that other variants and embodiments thereof are possible within the spirit and scope of the invention, the latter being defined by the appended claims.

The invention claimed is:

1. In a high-pressure pump for a fuel injection system of an internal combustion engine, the pump having at least one pump element including a pump piston driven in a reciprocating motion and guided displaceably in a cylinder bore of a pump housing part which piston defines a pump work chamber in the cylinder bore that can be filled with fuel from a fuel inlet via a suction valve in the intake stroke of the pump piston the suction valve having a pistonlike valve member which cooperates with a valve seat to completely close off communication of the pump work chamber from the fuel inlet, the valve member being urged in the opening direction by the pressure prevailing in the fuel inlet and to its closed position by the pressure prevailing in the pump work chamber, the valve member having a cylindrical shaft and a head of larger cross section compared to the shaft with at least the shaft of the valve member being guided displaceably in a guide bore of a valve housing, the improvement comprising guide portions embodied on the head of the valve member and guided displaceably in a bore of the valve housing, the guide portions being spaced apart from one another in the circumferential direction, and flowthrough portions of reduced cross section compared to the guide portions on the head of the valve member between the guide portions, by means of which flowthrough portions, a fuel flow out of the fuel inlet into the pump work chamber is enabled.

2. The high-pressure pump as defined by claim 1, further comprising an at least approximately frustoconical sealing face on the head of the valve member at the transition between the head and shaft, the sealing face cooperating with the valve seat.

3. The high-pressure pump as defined by claim 2, further comprising an annular groove disposed at the transition from the sealing face to the head of the valve member.

4. The high-pressure pump as defined by claim 1, further comprising a chamber in the valve housing defined by the face end of the valve member shaft guided in the bore, the chamber communicating constantly with the fuel inlet.

5. The high-pressure pump as defined by claim 2, further comprising a chamber in the valve housing defined by the face end of the valve member shaft guided in the bore, the chamber communicating constantly with the fuel inlet.

6. The high-pressure pump as defined by claim 3, further comprising a chamber in the valve housing defined by the face end of the valve member shaft guided in the bore, the chamber communicating constantly with the fuel inlet.

7. The high-pressure pump as defined by claim 4, further comprising a bore in the valve housing surrounding the shaft of the valve member in a region between its region located in the guide bore and the head of the valve member, the bore of the valve housing being of greater diameter compared to the guide bore, the fuel inlet discharging into the bore; and wherein the chamber defined by the shaft of the valve member communicates with the bore via at least one connecting bore in the valve housing.

8. The high-pressure pump as defined by claim 5, further comprising a bore in the valve housing surrounding the shaft of the valve member in a region between its region located in the guide bore and the head of the valve member, the bore of the valve housing being of greater diameter compared to the guide bore, the fuel inlet discharging into the bore; and wherein the chamber defined by the shaft of the valve member communicates with the bore via at least one connecting bore in the valve housing.

9. The high-pressure pump as defined by claim 6, further comprising a bore in the valve housing surrounding the shaft of the valve member in a region between its region located in the guide bore and the head of the valve member, the bore of the valve housing being of greater diameter compared to the guide bore, the fuel inlet discharging into the bore; and wherein the chamber defined by the shaft of the valve member communicates with the bore via at least one connecting bore in the valve housing.

10. The high-pressure pump as defined by claim 4, further comprising a bore in the valve housing surrounding the shaft of the valve member in a region between its region located in the guide bore and the head of the valve member, the bore of the valve housing being of greater diameter compared to the guide bore; an annular chamber formed between the valve housing and a bore of a pump housing part, into which the valve housing is inserted and into which annular chamber the fuel inlet discharges; and wherein the bore and the chamber defined by the shaft of the valve member each communicating via at least one respective connecting bore with the annular chamber.

11. The high-pressure pump as defined by claim 8, further comprising a bore in the valve housing surrounding the shaft of the valve member in a region between its region located in the guide bore and the head of the valve member the bore of the valve housing being of greater diameter compared to the guide bore; an annular chamber formed between the valve housing and a bore of a pump housing part, into which the valve housing is inserted and into which annular chamber the fuel inlet discharges; and wherein the bore and the chamber defined by the shaft of the valve member each communicating via at least one respective connecting bore with the annular chamber.

12. The high-pressure pump as defined by claim 9, further comprising a bore in the valve housing surrounding the shaft of the valve member in a region between its region located in the guide bore and the head of the valve member the bore of the valve housing being of greater diameter compared to the guide bore; an annular chamber formed between the valve housing and a bore of a pump housing part, into which the valve housing is inserted and into which annular chamber the fuel inlet discharges; and wherein the bore and the chamber defined by the shaft of the valve member each communicating via at least one respective connecting bore with the annular chamber.

13. The high-pressure pump as defined by claim 1, further comprising a closing spring braced preferably at least indirectly on the pump piston and engaging the valve member.

14. The high-pressure pump as defined by claim 2, further comprising a closing spring braced preferably at least indirectly on the pump piston and engaging the valve member.

15. The high-pressure pump as defined by claim 3, further comprising a closing spring braced preferably at least indirectly on the pump piston and engaging the valve member.

16. The high-pressure pump as defined by claim 4, further comprising a closing spring braced preferably at least indirectly on the pump piston and engaging the valve member.

17. The high-pressure pump as defined by claim 5, further comprising a closing spring braced preferably at least indirectly on the pump piston and engaging the valve member.

18. The high-pressure pump as defined by claim 6, further comprising a closing spring braced preferably at least indirectly on the pump piston and engaging the valve member.

19. The high-pressure pump as defined by claim 7, further comprising a closing spring braced preferably at least indirectly on the pump piston and engaging the valve member.

20. The high-pressure pump as defined by claim 10, further comprising a closing spring braced preferably at least indirectly on the pump piston and engaging the valve member.

* * * * *